US007817114B2

(12) United States Patent
Iseki et al.

(10) Patent No.: US 7,817,114 B2
(45) Date of Patent: Oct. 19, 2010

(54) DRIVER WITH DRIVING CURRENT INTERRUPTION

(75) Inventors: Masami Iseki, Kanagawa-ken (JP); Somei Kawasaki, Saitama-ken (JP); Fujio Kawano, Kanagawa-ken (JP); Takanori Yamashita, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 1265 days.

(21) Appl. No.: 10/994,310

(22) Filed: Nov. 23, 2004

(65) Prior Publication Data

US 2005/0122150 A1 Jun. 9, 2005

(30) Foreign Application Priority Data

Dec. 4, 2003 (JP) ..... 2003-405306
Nov. 15, 2004 (JP) ..... 2004-330680

(51) Int. Cl.
*H03K 5/153* (2006.01)

(52) U.S. Cl. ..... 345/76; 315/169.3

(58) Field of Classification Search ..... 345/76–83; 315/169.3; 313/463, 504
See application file for complete search history.

(56) References Cited

U.S. PATENT DOCUMENTS 5,699,085 A 12/1997 Takei et al. ..... 345/185
6,373,454 B1 4/2002 Knapp et al. ..... 345/76
6,864,665 B2 * 3/2005 Yoshida ..... 320/132

(Continued)

FOREIGN PATENT DOCUMENTS

EP 1282103 A 2/2003

(Continued)

OTHER PUBLICATIONS

European Search Report dated Jan. 4, 2010, in related corresponding European Patent Appln. No. 04028622.1.

*Primary Examiner*—Amare Mengistu
*Assistant Examiner*—Jennifer Zubajlo
(74) *Attorney, Agent, or Firm*—Fitzpatrick, Cella, Harper & Scinto

(57) ABSTRACT

A display apparatus includes a plurality of pixel circuits, wherein each of the pixel circuits comprises a light emitting element, a drive transistor for supplying the light emitting element with a current, as a driving current, of a quantity corresponding to a potential between a gate and a source of the drive transistor, a first switch for controlling a flow of the current supplied to the light emitting element, a second switch for switching between a first state of setting the potential between the gate and the source of the drive transistor and a second state of holding the potential between the gate and the source of the drive transistor, and a circuit for supplying the first switch with a signal for switching a state of controlling the flowing of the current of the driving current. In addition, a circuit supplies the second switch with a signal for switching the second switch between the first and second states, and a circuit sets the potential between the gate and the source of the driving transistor at a potential to flow the driving current so as to set the light emitting element at a low level driving state, at a time of starting a power source or a waiting state of the power source, and under a state that the first switch suppresses the flowing of the driving current and the second switch is at the first state.

2 Claims, 8 Drawing Sheets

U.S. PATENT DOCUMENTS

| | | | | |
|---|---|---|---|---|
| 7,532,207 | B2 | 5/2009 | Kawasaki et al. | |
| 2002/0135312 | A1* | 9/2002 | Koyama | 315/169.3 |
| 2003/0040149 | A1* | 2/2003 | Kasai | 438/200 |
| 2003/0209990 | A1* | 11/2003 | Kawasaki et al. | 315/169.3 |
| 2004/0183752 | A1 | 9/2004 | Kawasaki et al. | 345/20 |
| 2005/0007359 | A1 | 1/2005 | Iseki et al. | 345/204 |
| 2008/0157828 | A1 | 7/2008 | Kawasaki et al. | |
| 2008/0158112 | A1 | 7/2008 | Kawasaki et al. | |

FOREIGN PATENT DOCUMENTS

| | | |
|---|---|---|
| EP | 1455336 A | 9/2004 |
| JP | 5-158433 | 6/1993 |
| WO | WO 01/91094 | 11/2001 |

* cited by examiner

DRIVER WITH DRIVING CURRENT INTERRUPTION

BACKGROUND OF THE INVENTION

1. Field of the Invention

The present invention relates to a driver.

2. Related Background Art

In a flat display structured with the use of an electroluminescent element or a liquid crystal element, a matrix drive is popular which makes a selected picture element in an appropriate row display a predetermined indication, by connecting each row and each column of pixel circuits arranged in a plurality of rows by a plurality of columns in a circuit to respectively a scanning line and a data line, selecting each scanning line from a row scanning circuit, and at the same time, applying a predetermined display signal to each-data line from a column scanning circuit.

For instance, patent document 1 discloses an electroluminescent display driven by an active matrix.

In addition, patent document 2 discloses a display provided with a plurality of display elements (LED) to be selectively and simultaneously driven; a memory device for storing display data to be displayed on the display elements; a memory control device for producing a display-inhibiting signal for a certain period after the power is turned on and before the above described display data of the above described memory device are decided; and a display drive control device for interrupting the supply of a driving current to the above described display elements, when the memory control device produces the above described display-inhibiting signal.

In addition, a display is known which uses an electron emission element as a display element.

Furthermore, a drawing device is known which draws a picture with an electron beam emitted from an electron emission element.

A drive circuit has been desired which can stably drive these elements.

[Patent Document 1] U.S. Pat. No. 6,373,454

[Patent Document 2] Japanese Patent Application Laid-Open No. 05-158433

SUMMARY OF THE INVENTION

One of objects of the invention according to the present application is to realize a drive circuit which can stably work.

One of drive circuits according to the present application is configured as described below.

A driver for driving an element comprising:

a drive transistor for supplying a current of the quantity corresponding to a gate potential, into the element as a driving current;

a first switch installed in the path of the driving current passing between the element and the drive transistor, for controlling the flow of the driving current;

a second switch for switching between the first state of setting the gate potential of the drive transistor and the second state of keeping the set gate potential;

a circuit for supplying a signal for controlling the flow of the driving current in a restricted state to the first switch, for a predetermined period in a period after starting the supply of a potential for driving the drive transistor from a power source and until a start of driving the element in a normal operation;

a circuit for supplying a signal for setting the second switch to the first state, at the second switch: and a circuit for interrupting a signal for setting the gate potential while the second switch is in the first state in the predetermined period.

Here, the driver can preferably adopt a configuration further comprising a plurality of drive circuits arranged in a matrix form, each of which has a drive transistor and a first switch. In addition, the driver can preferably adopt a configuration further comprising a plurality of drive circuits arranged in a matrix form, each of which has the drive transistor and the second switch. In addition, the driver can preferably adopt a configuration in which a signal for setting a gate potential is a current signal having a current value corresponding to a requested driving state of the element. In addition, the driver can preferably adopt a configuration in which the drive transistor, the first switch, the second switch, the circuit for supplying the signal to the first switch, and the circuit for supplying the signal to the second switch are arranged on a common insulative substrate. Here, the driver can preferably adopt a configuration in which a potential supplied from the power source is also supplied to a circuit for supplying the signal to the first switch, and a circuit for supplying the signal to the second switch.

In addition, one of drivers according to the present application is configured as described below.

A driver for driving an element comprising:

a drive transistor for supplying a current of the quantity corresponding to a gate potential, into the element as a driving current;

a first switch installed in the path of the driving current between the element and the drive transistor, for controlling the flow of the driving current;

a second switch for switching between the first state of setting the gate potential of the drive transistor and the second state of keeping the set gate potential;

a circuit for supplying a signal for controlling the flow of the driving current in a restricted state to the first switch, for a predetermined period in the period after starting the supply of a potential for driving the drive transistor from a power source and until a start of driving the element in a normal operation;

a circuit for supplying a signal for keeping the second switch in the first state, to the second switch; and a circuit for supplying a signal for setting the gate potential to a potential for supplying the driving current so as to control the element to a low level of a driving state while the second switch is in the first state for the predetermined period, as the signal for setting the gate potential.

In addition, one of drivers of the invention according to the present application is configured as described below.

A driver for driving an element comprising:

a plurality of drive circuits arranged in a matrix form for driving each of the plurality of elements, each of which has a driving transistor for supplying a driving current to the element, and a switch installed in the current path of the driving current between the element and the driving transistor, for controlling the flow of the driving current;

a plurality of hard-wires by which every part of the plurality of the drive circuits arranged in the matrix form are each connected; and a circuit for simultaneously supplying a signal for controlling the switch to the state of restricting the flow of the driving current, to each of the switches in the plurality of the drive circuits arranged in the matrix form, through the plurality of the hard-wires.

The driver can preferably adopt a configuration where the plurality of the drive circuits arranged in the matrix form has a plurality of data lines by which every part of the drive circuits is each connected; and the plurality of the hard-wires also serve as hard-wires for supplying a control signal for keeping the flow of the driving current in the current path between the drive transistor and the element in the restricted state, to the selected drive circuit, in the period while the gate potential of the drive transistor is set according to a modulating signal supplied from the data line, in the selected drive circuit.

Specifically, the plurality of the above described hard-wires can be used as scanning lines for connecting a plurality of drive circuits arranged in a matrix form. More specifically, at some point in time (specifically, when a power source is turned on), signals for restricting the flow of the driving current in the current path between a drive transistor and an element are simultaneously sent to each of the plurality of the drive circuits arranged in the matrix form with the use of a scanning line. On the other hand, during a normal scanning drive, for instance, during displaying, the driver selects one to several scanning lines among a plurality of scanning lines by scanning, and writes the signal sent through data lines on each of drive circuits connected to the selected scanning line. In the writing operation, the element driven by the writing drive circuit is desirably in a non-driven state, so that during the writing operation, a driving current passing through the current path between the drive transistor and the element is preferably kept in a restricted state. In this case, in the drive circuit connected to the not-selected scanning line, the element is driven, specifically, the driving current passes through the current path between the drive transistor and the element. Accordingly, during the normal scanning drive, the driver sends control signals for restricting the flow of the driving current in the current path between the drive transistor and the element, selectively to the drive circuit to which data are written (to which the gate potential of the drive transistor is set). The embodiments as shown below realize a simple wiring configuration by using the same wiring in both cases of simultaneously supplying signals for restricting the flow of a driving current through the current path between the drive transistor and the element to the plurality of the drive circuits arranged in the matrix form through the plurality of the hard-wires, and supplying the signals while scanning during the normal scanning drive.

In addition, one of drivers according to the present application is configured as described below.

A driver for driving an element comprising:

a plurality of drive circuits arranged in a matrix form for driving each of a plurality of elements, each of which has a driving transistor for supplying a driving current to the element, and a switch for switching between the first state of setting a gate potential of the drive transistor to the potential in which the drive transistor can pass a predetermined driving current and the second state of keeping the set gate potential;

a plurality of hard-wires by which every part of the plurality of the drive circuits arranged in the matrix form are each connected; and a circuit for simultaneously supplying a signal for controlling the switch to the first state, to each of the switches in the plurality of the drive circuits arranged in the matrix form, through the plurality of the hard-wires.

The driver can preferably adopt a configuration further comprising a plurality of data lines by which every part of the plurality of the drive circuits arranged in the matrix form is connected; and a circuit for interrupting a supply path of supplying a modulating signal to the plurality of the drive circuits from each of the plurality of the data lines, when simultaneously supplying the signals to each of the switches in the plurality of the drive circuits arranged in the matrix form, through the plurality of the hard-wires.

In addition, the driver can preferably adopt a configuration in which the plurality of the drive circuits arranged in the matrix form have a plurality of data lines by which every part of the drive circuits is each connected; and the plurality of the hard-wires serve as scanning lines for selecting the drive circuits for setting the gate potential of the drive transistor according to a modulating signal supplied from the data lines during a scanning drive.

In addition, one of drivers according to the present application is configured as described below.

A driver for driving a display element comprising:

a plurality of drive circuits arranged in a matrix form for driving each of a plurality of display elements, each of which has a driving transistor for supplying a driving current to the display element, and a first switch installed in the current path of the driving current between the display element and the driving transistor, for controlling the flow of the driving current; and a circuit for supplying a signal for controlling the flow of the driving current in a restricted state to the first switch, for a predetermined period after starting supply of the potential for driving the drive transistor and until a start of driving the plurality of the display elements in a normal operation.

Here, the elements arranged in a matrix form or the drive circuits arranged in a matrix form in the present application is not limited only to a configuration in which each element or each drive circuit is precisely lined on a plurality of straight lines that are parallel each other, and a plurality of straight lines that are perpendicular to them, but means the arrangement enabling a matrix drive (a drive for selecting an object to be selected on every part and supplying corresponding modulating signals to the selected element or a drive circuit). Specifically, a plurality of drive circuits have only to logically configure a matrix, and can adopt a configuration in which each circuit is not precisely lined on a plurality of straight lines parallel each other and a plurality of straight lines perpendicular to them, such as delta arrangement, as a physical arrangement.

In addition, the present application includes the invention of the display which specifically comprises the above described driver and the above described element as a display element. Here, the usable display includes an electroluminescent element such as an organic electroluminescent element, light emitting diode and an electron emission element such as an electrolysis emission element. (In the case of using an electron emission element as a display element, it is recommended to combine it with a luminous body such as a fluorescent substance which emits light by emitted electrons.)

In addition, the present application includes the invention of the recorder which specifically comprises a recording device for recording image information in a recording medium, and the display for displaying pictorial images based on the image information recorded in the recording medium.

Specifically, a display according to the present application can be preferably used in potable information instruments such as a digital camera, a video recorder, a mobile telephone and PDA. These information instruments can record image information in a built-in recording medium such as a semiconductor memory and a hard disk, and a removable recording medium such as a semiconductor memory and a hard desk. A display according to the present application can be preferably used for a display for displaying the pictorial images based on the image information.

DESCRIPTION OF THE PREFERRED EMBODIMENTS

In the following, specific configuration examples of a display which employs a display element, particularly an electroluminescent element for an element to be driven, will be described.

Figure 1:
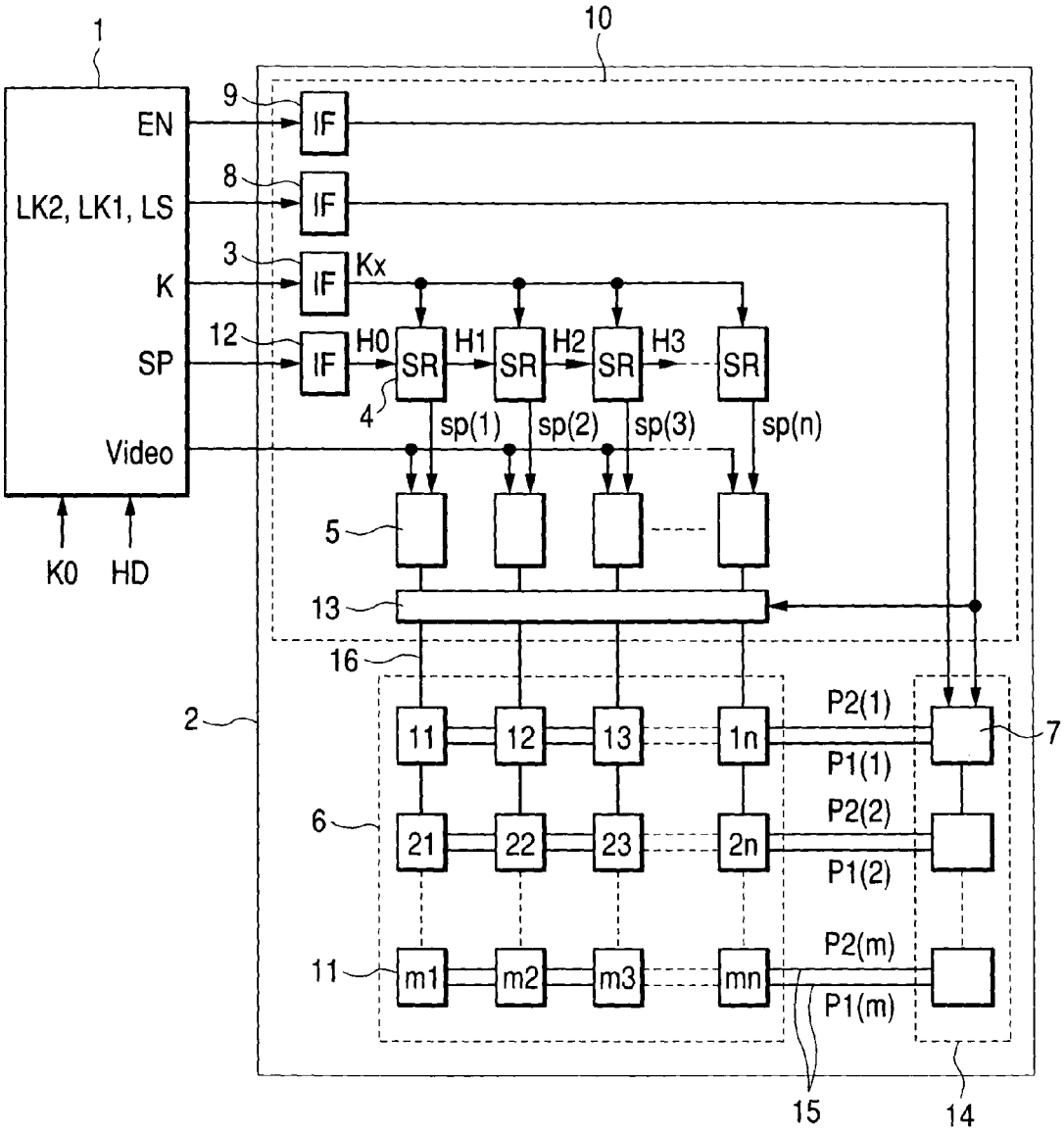
FIG. 1 is a block diagram in one embodiment of an electroluminescent display according to the present invention.
Figure 4:
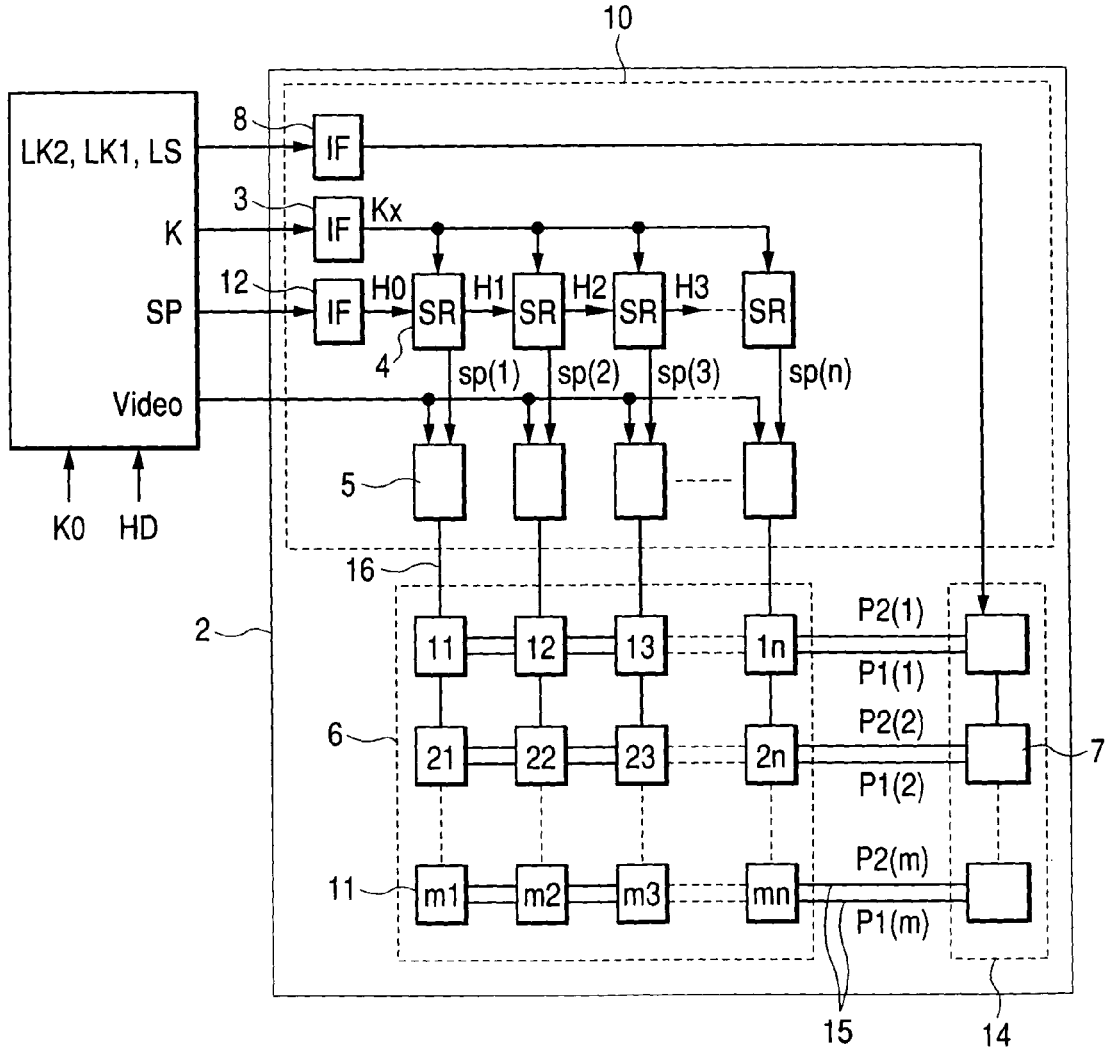
FIG. 4 is a block diagram in one example of an electroluminescent display.

FIG. 4 shows a block diagram for one example of an EL display of a matrix drive. Here, FIG. 4 shows a basic configuration of a display for describing problems considered in the present embodiment, and a specific example of a display according to the present embodiment is shown in FIG. 1.

In the figure, reference numeral 1 denotes an external control circuit, 2 a display panel, 3, 8 and 12 level conversion circuits, 4 a column shift register, 5 a column control circuit, 6 an image display section, 7 a row shift register, 10 a column drive circuit, 11 a pixel circuit, 14 a row drive circuit, 15 a scanning line and 16 a data line.

An EL display is provided with, for instance, an external control circuit 1 and a display panel 2, and the display panel 2 is provided with an image display section 6, a column drive circuit 10 and a row drive circuit 7. In the image display section 6, pixel circuits 11 are arranged to form a plurality of columns by a plurality of columns (m rows by n columns in FIG. 4), the pixel circuits 11 in each row are connected to a scanning line 15 in common, and the pixel circuits 11 of each column are connected to a data line 16 in common.

In the above described configuration, a timing signal LK1, a clock signal LK2 and a start signal LS are input to a row shift register 7 from an external control circuit 1, and scanning line signals P1(*r*) and P2(*r*) (r=1 to m) are output to each scanning line 15. In addition, a column shift register 4 outputs a sampling signal sp(q) (q=1 to n) to a column control circuit 5, by a clock signal K and a start signal SP input from the external control circuit 1, and the column control circuit 5 samples the picture signal of the appropriate picture element from a picture signal Video input from the external control circuit 1 by the input of a sampling signal sp(q), and outputs a current signal i(data) to a data line 16.

Figure 5:
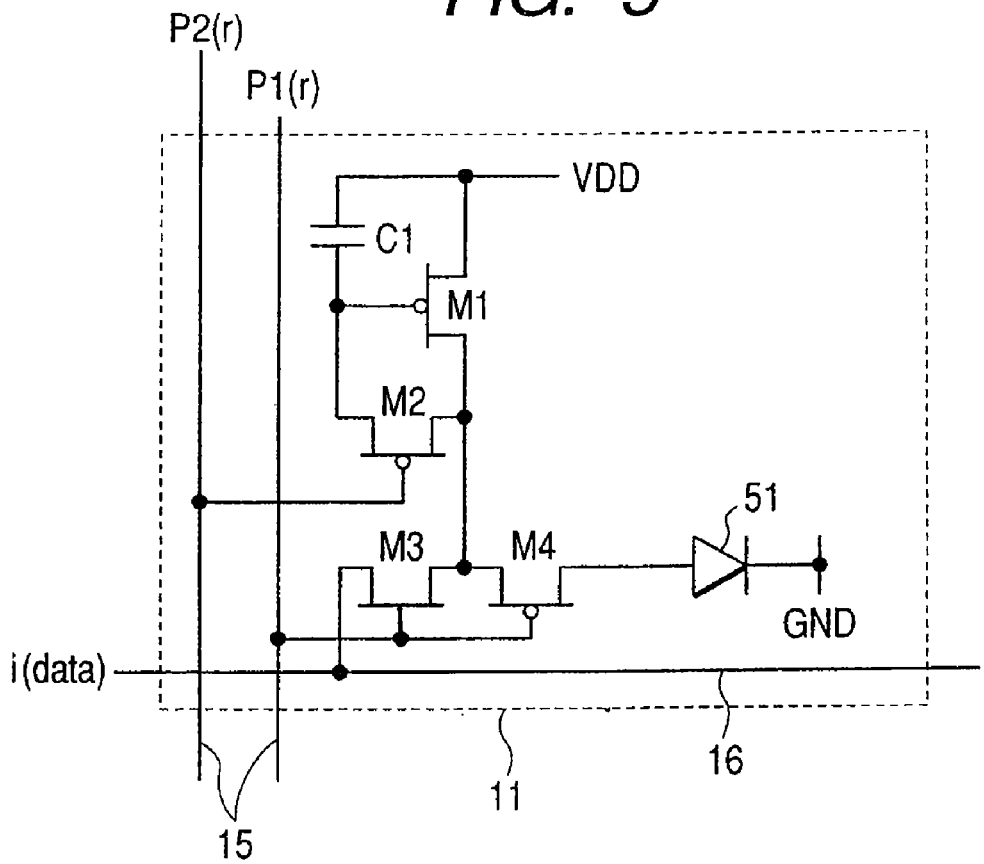
FIG. 5 is a configuration example of a pixel circuit in an electroluminescent display.

FIG. 5 shows a configuration example of a pixel circuit 11. The pixel circuit 11 includes an electroluminescent element 51, transistors M1 to M4, a capacitor C1 and a power source VDD. A pixel circuit is constituted by an electroluminescent element 51 of an element to be driven, and a drive circuit for driving the element. A drive circuit is constituted by a drive transistor M1, a capacitor C1 for keeping the gate potential of the drive transistor, a transistor M4 of a switch for controlling the flow of a driving current in a current path between the drive transistor M1 and the element 51, and a transistor M2 which is a switch for switching the state between the state of setting the gate potential of the drive transistor M1 and the state of keeping the set gate potential. In addition, in the embodiment, a transistor M3 of a switch for passing a modulating signal to a drive transistor M1 when the gate potential of the drive transistor M1 is set, and prevents the modulating signal from being input to the drive transistor M1 after the gate potential has been set, is arranged in the drive circuit. As the transistor for use in the present invention, a conventional transistor formed from a monocrystalline semiconductor may be selected. While, a thin film transistor (TFT) formed from non-monocrystalline semiconductor such as polycrystalline silicon and amorphous silicon may be suitable. Referring to a time chart in FIG. 6, the operation of a pixel circuit 11 in FIG. 5 will be now described. In the following description, a source, a drain and a gate of a transistor will be respectively described as /S, /D and /G.

A scanning signal P1(*r*) which is input into a scanning line 15 of an appropriate row r is "L" and P2(*r*) is "H", before the time t0. Accordingly, both of M2 and M3 are in an "off" state, M4 is in an "on" state, and the electroluminescent element 51 emits light by a current poured into the electroluminescent element 51 by M1/G voltage which is determined by a charged voltage held by the capacitor C1 and the gate capacitor of M1. At the time t0, the scanning line signal P1(*r*) in the appropriate row r is changed to "H" and P2(*r*) to "L", and then the current signal i(r) of the row r is simultaneously determined. Then, both of M2 and M3 are turned on and M4 is turned off, which stops the pouring of the current into the electroluminescent element 51 of the picture element, and turns off the light of the electroluminescent element 51. At the same time, the current signal i(r) is supplied to M1 and M2 through M3, thereby the M1/G voltage is set, and the capacitor C1 and the gate capacitor of M1 are charged. At the time t1 when the current signal i(r) is decided, P2(*r*) is again changed to "H" and M2 is turned off, which finishes the setting operation of the M1/G voltage and shifts to the holding operation of the current signal i(m). At the time t2, P1(*r*) is changed to "L" and stops the supply of the current signal i(data) to M1, and M4 is simultaneously turned on to pour a drain current of M1 set by the M1/G voltage into the electroluminescent element 51, which emits light according to the level of the current signal i(r).

Figure 6:
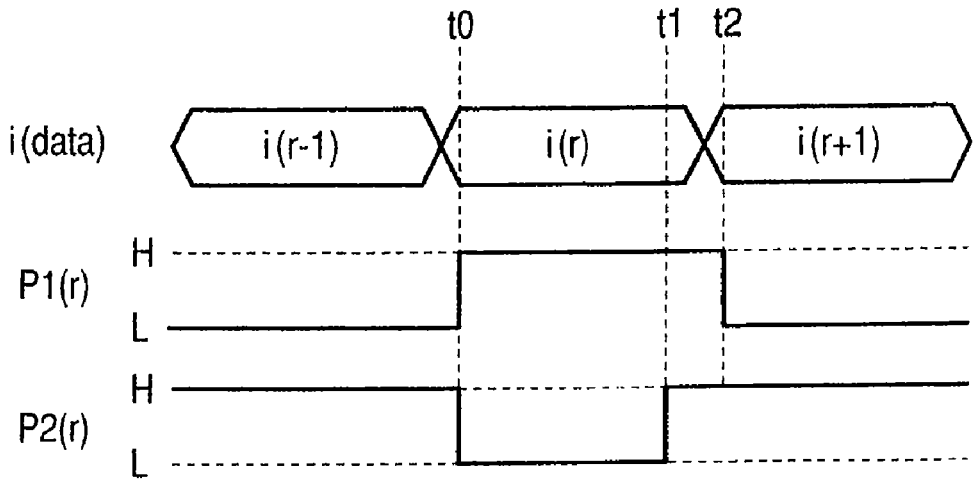
FIG. 6 is a time chart of operation of a pixel circuit in FIG. 5.
Figure 7:
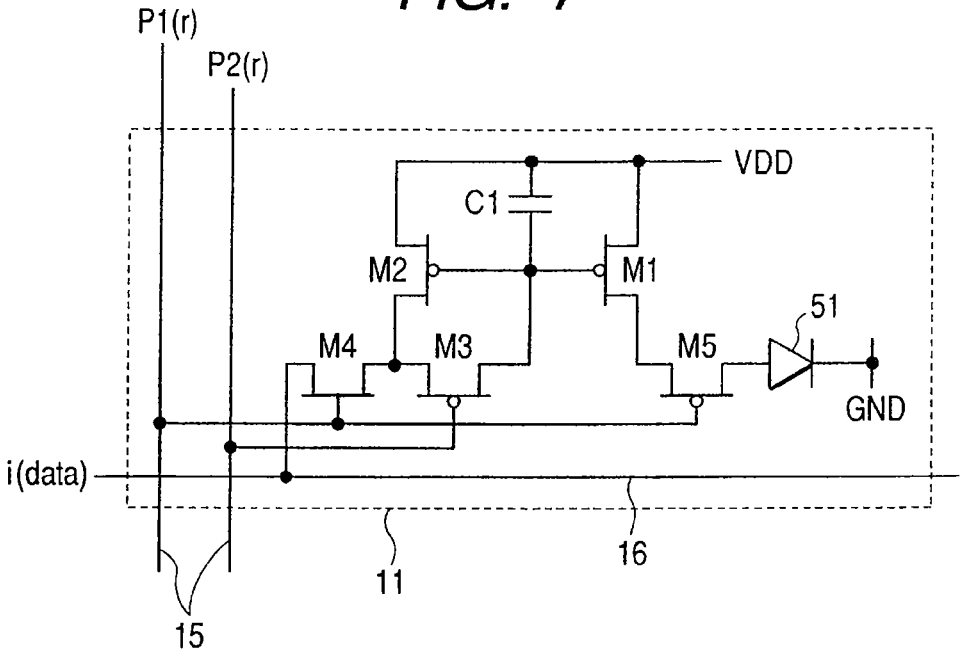
FIG. 7 is another configuration example of a pixel circuit in an electroluminescent display.

FIG. 7 shows another configuration example of a pixel circuit 11 in FIG. 4. In the figure, reference character M denotes TFT, and the other reference characters denote the same members as in FIGS. 4 and 5. Referring to a time chart in FIG. 6, the operation of a pixel circuit in FIG. 5 will be now described.

Before the time t0, a scanning signal P1(*r*) in an appropriate row r is "L" and P2(*r*) is "H", so that both of M3 and M4 are turned off, and M5 is turned on.

Then, by an M1/G voltage determined by the charged voltage held in the capacitor C1 and the gate capacitors of M1 and M2, a current is poured into an electroluminescent element 51, and the electroluminescent element 51 emits light according to the value of the current. At the time t0, P1(*r*) is changed to "H" and P2(*r*) to "L", and simultaneously the current signal i(r) of the row r is decided. Thereby, both of M3 and M4 are turned on and M5 is turned off, the current signal i(r) is supplied to M2 through M4, the M2/G voltage is set according to the value of the current, the capacitor C1 and the gate capacitors of M1 and M2 are charged, and the pouring of the current into the electroluminescent element 51 is stopped. At the time t1 when the current signal i(r) is decided, P2(*r*) is changed to "H" and M3 is turned off, which finishes the setting operation of M1/G voltage and shifts to the holding operation. At the time t2, P1(*r*) is changed to "L" to stop the supply of the current signal i (data) to M2, but the M1/G and M2/G voltages set by the current signal i(r) remains held, and M5 is turned on to pour the drain current of M1 set by the M1/G voltage into the electroluminescent element 51 which emits light according to the level of the current signal i(r).

Figure 2:
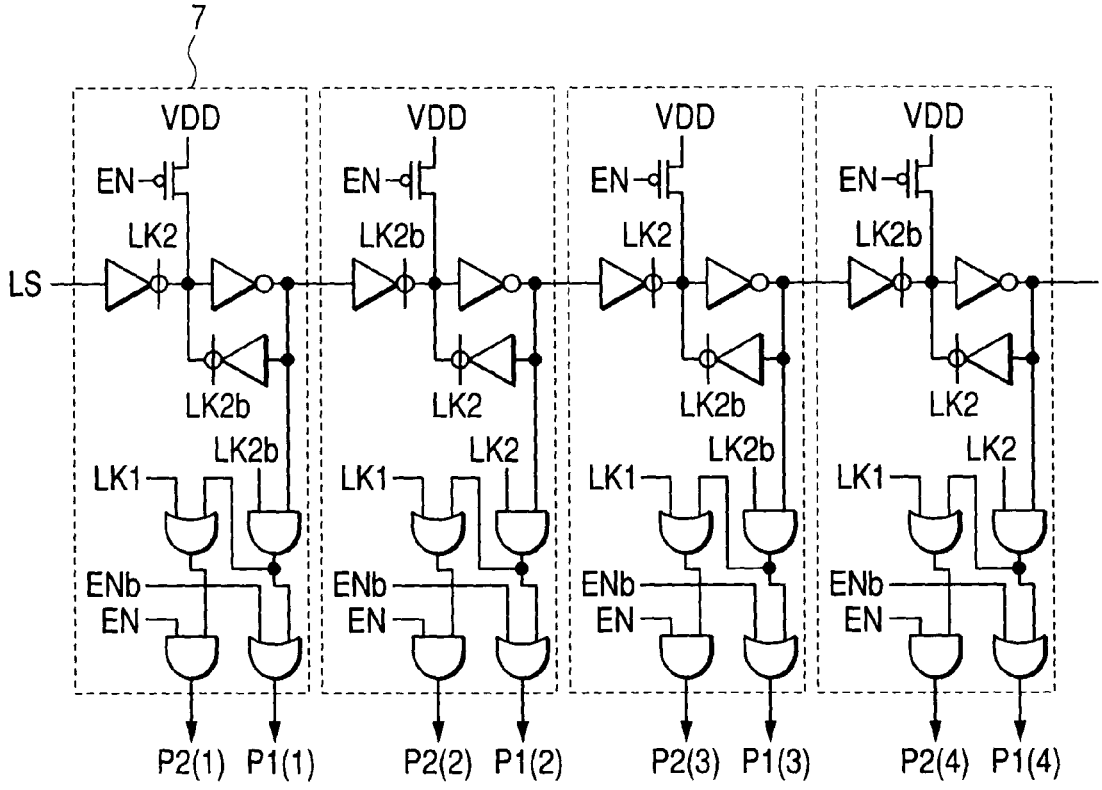
FIG. 2 is a configuration example for a row shift register of an electroluminescent display in FIG. 1.
Figure 8:
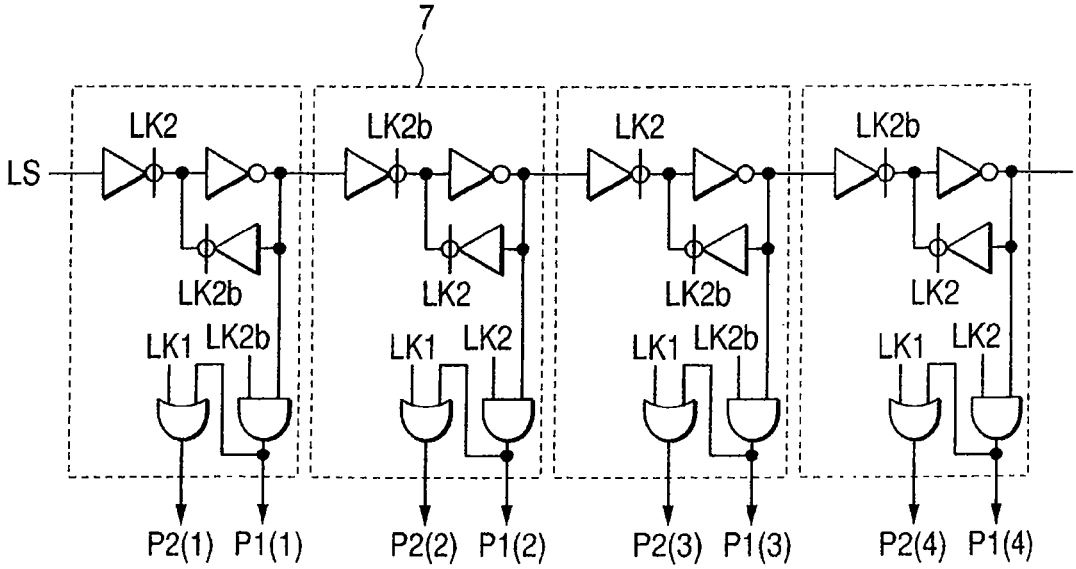
FIG. 8 is a configuration example for a row shift register of an electroluminescent display in FIG. 4.
Figure 9:
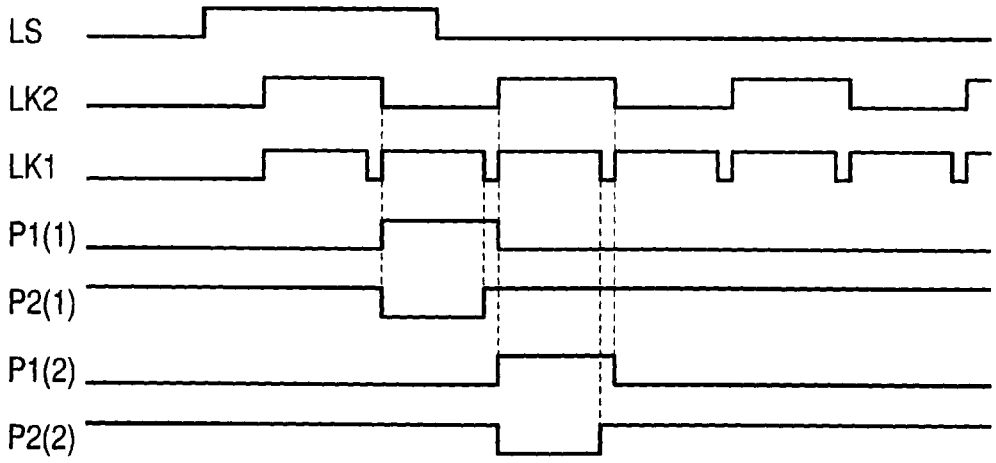
FIG. 9 is a time chart of the operation of a row shift register in FIG. 8.

FIG. 8 shows a configuration example of a shift register 7 for describing problems considered in the present embodiment, and a shift register 7 actually according to the present embodiment is configured as in FIG. 2. In FIG. 8, LK2*b* is a polarity-reversed differential signal of a clock signal LK2. FIG. 9 shows a time chart of an appropriate row shift register 7.

A row shift register 7 in FIG. 8 allows a timing signal LK1, a clock signal LK2 and a start signal LS input, sequentially produces control signals through a resistor configuration by flip-flop of a clocked inverter configuration, further produces timing signals necessary for the pixel circuit operation by a gate circuit, and outputs scanning signals P1(*r*) and P2(*r*) to each scanning line 15.

Figure 10:
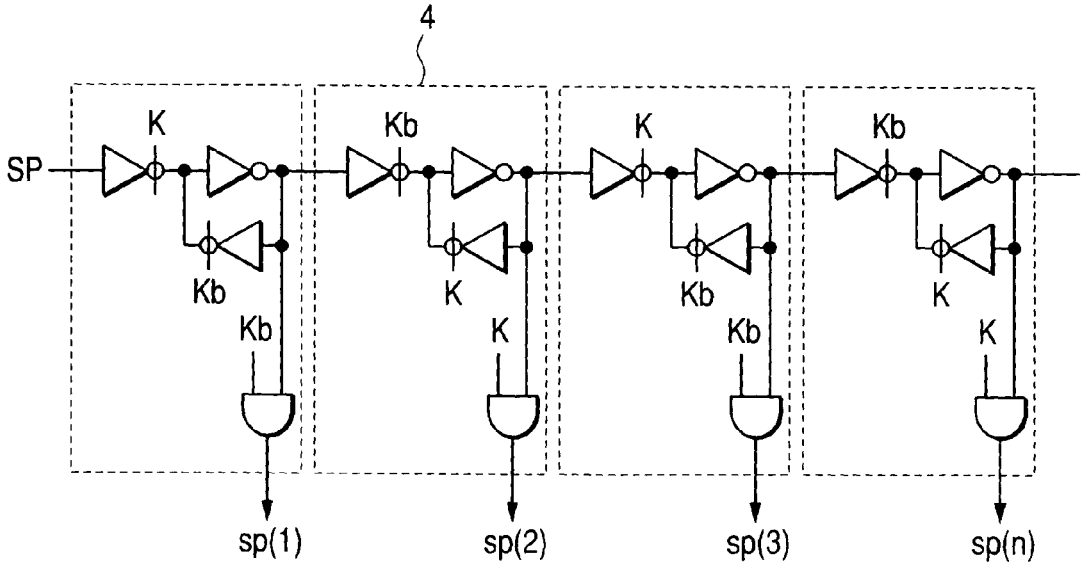
FIG. 10 is a configuration example for a column shift register of an electroluminescent display in FIG. 4.
Figure 11:
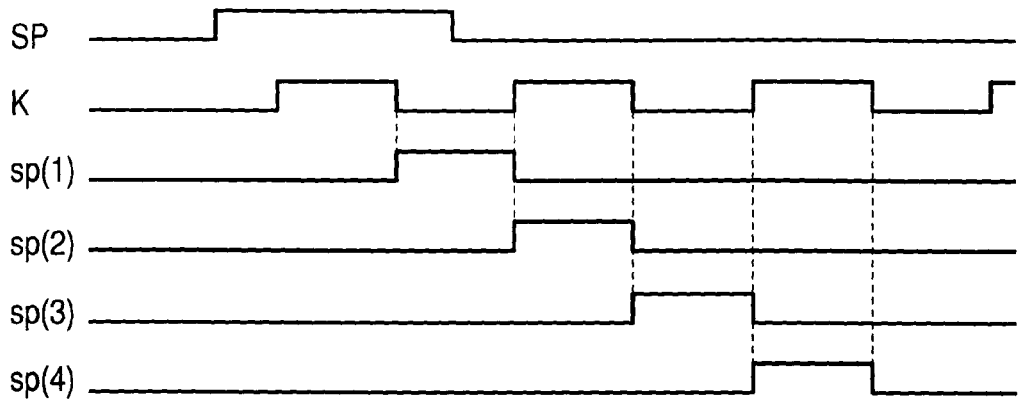
FIG. 11 is a time chart of the operation of a column shift register in FIG. 10.

FIG. 10 shows a configuration example of a column shift register 4 in FIG. 4. In the figure, reference character Kb denotes a polarity-reversed differential signal of a clock signal K. FIG. 11 shows a time chart of an appropriate shift register 4.

A column shift register 4 in FIG. 10 allows a clock signal K and a start signal SP to be input, sequentially produces control signals through a resistor configuration by flip-flop of a clocked inverter configuration, further produces timing signals necessary for the pixel circuit operation by a gate circuit, and outputs sampling signals sp(q) to each data line 16.

If a basic configuration shown in FIG. 4 or FIG. 8 is adopted for an EL display as described above, and if the configuration has scanning line signals P1(*r*) and P2(*r*) for controlling the operation of the pixel circuit unstable at the time of turning the power source of the display on, for instance, if it has P1(*r*) of "L" and P2(*r*) of "L" in the pixel circuit 11 in FIGS. 5 and 7, when the power source is turned on, the configuration has a state in which a current is supplied to an electroluminescence element 51. At this moment, a gate/source voltage of M1 which determines the EL driving current of the pixel circuit 11, is not set and indefinite when the power source is turned on, and cannot control the current flowing into the electroluminescent element 51, so that the configuration can supply an excessive current to the electroluminescent element 51 leading to destruction of the element.

In addition, even if the voltage held by the capacitor C1 and M1/G in the circuit in FIGS. 5 and 7 is in such a level as not to supply a current to the electroluminescent element 51, in a waiting state of no image displayed but the power turned on, the voltage can be changed to such a level as to be able to supply an excessive current to the electroluminescent element 51 by a leakage current after a lapse of a long time, and can damage the electroluminescent element 51.

In order to solve such problems, the present embodiment adopts a configuration described below.

Specifically, the configuration controls a driving current flowing through a current path between a drive transistor and an element so as to be restricted, in order to realize stable operation when a power source is turned on, and sets the gate potential of the drive transistor in the state equivalent to a state of non-receiving an input signal causing a current flow into the element, when the power source is turned on.

FIG. 1 shows a block diagram of one preferred embodiment of an EL display according to the present invention. In the figure, reference numeral 9 denotes a level conversion circuit, 13 denotes a switching circuit, and the same reference numerals and characters as those in FIG. 4 denote the same member. In the present embodiment, a pixel circuit 11 employs the circuit in FIG. 5 or 7 described previously.

An EL display according to the present invention has a switch control signal EN input into a row shift register 7 from an external control circuit 1, and has scanning signals P1(*r*) and P2(*r*) output to a scanning line 15 from the row shift register 7, controlled according to the polarity of the electric switch control signal EN.

Specifically, in the operation of the pixel circuit 11, a period between t0 and t2 in a time chart in FIG. 6 is named as a first period in which the pixel circuit 11 retains a holding voltage corresponding to the current signal i (data), and a period between t2 and next t0 is named as a second period in which the pixel circuit 11 supplies a current corresponding to the holding voltage to the electroluminescent element 51, to make the electroluminescent element 51 emit light. Then, in a period in which the electroluminescent element 51 is desired to be prevented from being damaged, such as a time of turning a power source on and a stand-by state, the switch control signal EN of the first polarity forcibly sets the all pixel circuits 11 arranged in a matrix to the first period and interrupts the supply of the current to the electroluminescent element 51, whereas in the normal display drive period, the switch control signal EN having been changed to the second polarity sequentially sets the pixel circuit 11 in each row to the first and second periods similarly to the conventional way, and holds the current signal i (data) to make the electroluminescent element 51 emit light.

The EL display in FIG. 1 is an example of further installing a switching circuit 13 therein. To the switching circuit 13 as well, the above described switch control signal EN is input, and controls the transfer and interruption of the current signal sent from a column control circuit 5 to the pixel circuit 11 by changing its polarity. The switching circuit 13 is constituted by an n-type TFT for instance, and has a configuration in which the source (or a drain) is connected to the row control circuit 5 side of the data line 16, the drain (or the source) is connected to the pixel circuit 11 side of the data line 15, and the switch control signal EN is input to the gate.

FIG. 2 shows a configuration example of a row shift register 7 in FIG. 1. In the figure, reference character ENb denotes a polarity-reversed differential signal of EN and is generated in a display panel by reversing the polarity of EN. Reference character VDD denotes a power source.

The circuit in FIG. 2 has a p-type TFT for resetting a shift register controlled by the switch control signal EN, and an "OR" gate and an "AND" gate, to which the switch control signal EN and ENb are input, in addition to the circuit having a configuration shown in FIG. 8. By the configuration, when the switch control signal EN is in the first polarity, or equivalently, "L" in the present embodiment, the row shift register 7 outputs the scanning line signal P1(*r*) of "H" and P2(*r*) of "L".

Figure 3:
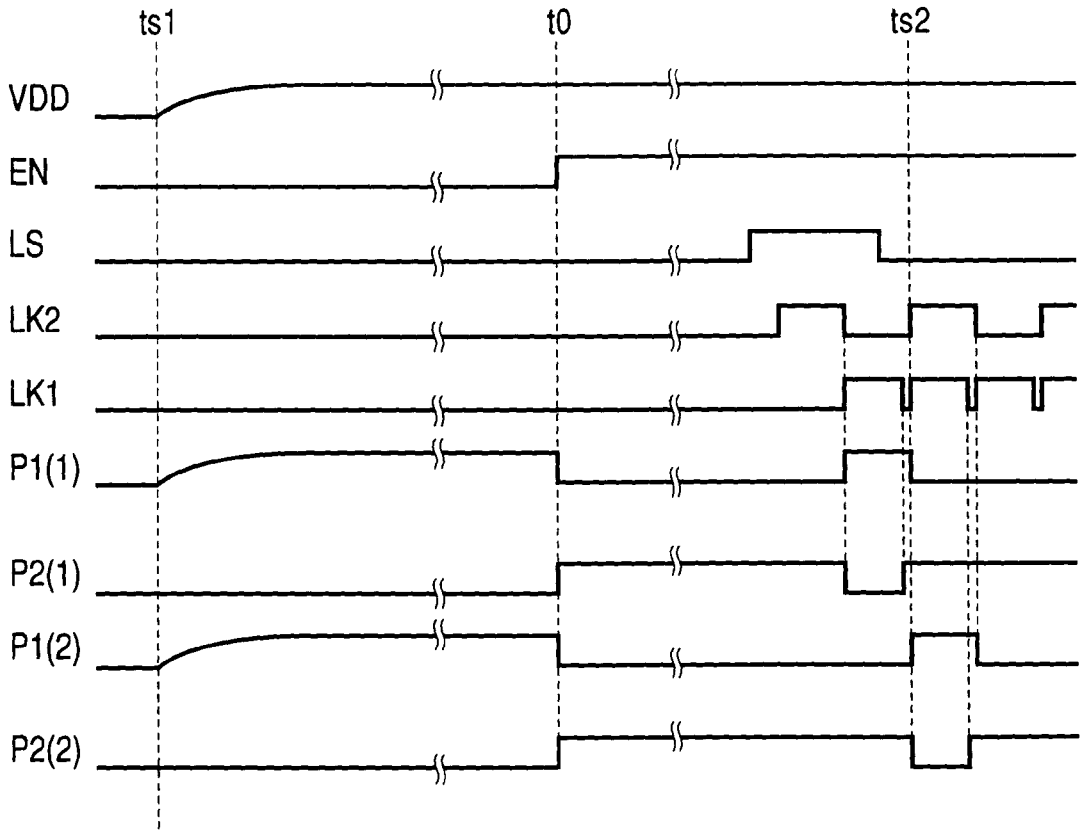
FIG. 3 is a time chart of the operation of a row shift register in FIG. 2.

The operation of a circuit in FIG. 2 will be now described with reference to a time chart in FIG. 3.

The time ts1 is defined as the time when a power source has started the supply of a potential for driving each factor such as a drive transistor. Time ts2 is the time when the circuit starts driving the elements into a normal operation. Time t0 is defined the time when an enabled state is canceled. A period before t0 is defined as the enabled period. In the period before the time t0, a switch control signal EN=L is input into the row shift register 7, and the scanning signal P1(*r*) of "H" and P2(*r*) of "L" are output to the all scanning lines 15. Then, in the period, in the all pixel circuits 11, TFT (M4 in FIG. 5 and M5 in FIG. 7) for supplying a current to the electroluminescent element 51 is turned off, so that the current is not supplied to the electroluminescent element 51. In addition, because P2(*r*) is "L", M1 is turned to a diode-connected state.

In addition, the switch control signal EN=L is also input into the switching circuit 13, so that the n-type TFT constituting the circuit is turned off, and the current between the column control circuit 5 and the pixel circuit 11 is interrupted. Consequently, in the pixel circuit 11, even if the voltage between a gate and a source of M1 is in a ready state of outputting a current, because a current-supplying target is interrupted, the drain current charges the capacitor C1 connected to its own gate, and increases a gate voltage until a drain current becomes so small as to be equal to zero or considerably close to zero.

After this, the control signal EN is simply set to "H" to make the switching circuit 13 to be in a state capable of transferring a current signal to the pixel circuit 11 from the column control circuit 5. Then, even when the current supply path between the pixel circuit 11 and the electroluminescent element 51 is turned on, because the voltage of M1/G in the pixel circuit 11 is raised to such a level as not to output a current, the current is not supplied to the electroluminescent element 51.

After the time t0, when the circuit enters a normal display drive period, the switch control signal EN is turned to "H", and then the row shift register 7 is operated as in the case of the row shift register in FIG. 8, and waveforms between t0 and t2 in FIG. 6 are sequentially output to the scanning line 15 of each row. In addition, in the switching circuit 13, the current signal output from the column control circuit 5 by the input of EN=H is transferred to the pixel circuit 11. Thereby, the pixel circuit 11 shown in FIGS. 5 and 7 is sequentially operated at each row pursuantly to the time chart in FIG. 6, sets the M1/G voltage according to the current signal i (data), and makes the electroluminescent element 51 emit light according to the level of the current signal i (data).

When the power source is turned off, the enabling signal EN is turned to a low level at first. Subsequently, LS, LK1 and LK2 are stopped. And then, the supply of the potential from the power source is stopped. Here, LS, LK1 and LK2 may be stopped before turning the enabling signal EN to a low level.

In addition, the present embodiment shows the configuration of interrupting the modulating signal to be supplied to the element by a switching circuit 13, but instead of installing such an interruption circuit, the configuration of supplying such signals from the outside as to make the pixel circuit in a low level of a driving state such as a black level or a low gradation level, in the period in which signals are interrupted by the switching circuit 13 in the embodiment described above, can be adopted. Specifically, it is recommended to make the video signal given from the external control circuit 1 to be in a low level. The low level of a driving state referred here means a half or lower level (including a 0 level) of the maximum drive level (when a display element displays gradation, the drive level capable of exhibiting the maximum gradation value).

In addition, the present embodiment shows the configuration of supplying a current signal having the current value corresponding to a requested driving state of an element as a modulating signal and setting the gate potential of a drive transistor to a potential corresponding to the current signal, but can show the configuration of supplying the modulating signal as a voltage signal, or equivalently, a signal having an electric potential corresponding to the requested driving state of the element. The configuration of supplying the voltage signal as a signal for setting the gate potential of the drive transistor can adopt either a configuration of interrupting a signal by using a switching circuit as described in the above embodiment, or a configuration of applying such a signal as to set an electric potential of passing a driving current which causes a low level of a driving state. Here, in the configuration of supplying the voltage signal as a signal for setting the gate potential of the drive transistor, a configuration of applying such a signal as to set an electric potential of passing a driving current which causes a low level of a driving state can be preferably adopted.

Figure 12:
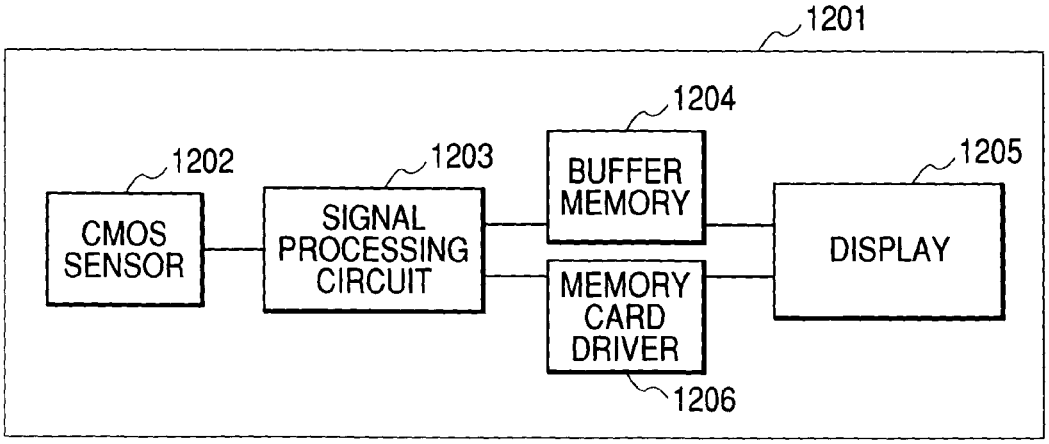
FIG. 12 is a drawing showing a configuration of a digital camera of a recorder according to the present application.

FIG. 12 shows the configuration in a digital camera 1201 which is a recorder using a display according to the present invention. A CMOS sensor 1202 is an optical sensor for receiving a light taken from the outside and converting it to an electrical signal. The signal output from the CMOS sensor 1202 is contouring-highlight-treated in a signal processing circuit 1203. When an immediate display is desired, the signal from the signal processing circuit 1203 is temporarily recorded in a buffer memory 1204, then is output to a display 1205 of a display shown in FIG. 1, and is visualized by the display 1205. On the other hand, when the signals are to be recorded in the memory card, the signal is output from the signal processing circuit 1203 to the memory card driver 1206, and recorded in the inserted memory card.

Here, a digital camera is shown as an example of a recorder using a display according to the present application, but a display according to the present application is applicable to a recorder such as a video camera, PDA and a portable telephone as elsewhere. In these portable devices, the power source of a display is frequently turned on and off in order to save a power consumption. Accordingly, in these portable devices, a display using a driver according to the present application can be particularly preferably adopted.

This application claims priority from Japanese Patent Application Nos. 2003-405306 filed on Dec. 4, 2003 and 2004-330680 filed on Nov. 15, 2004, which are hereby incorporated by reference herein.

What is claimed is:

1. A display apparatus comprising:

a plurality of pixel circuits arranged in a matrix, wherein each of the pixel circuits comprises:

a light emitting element;

a drive transistor for supplying the light emitting element with a drive current of a quantity corresponding to a gate potential of the drive transistor;

a first switch for switching between a first drive state of shutting off the drive current to the light emitting element and a second drive state of flowing the drive current to the light emitting element to control a flow of the drive current supplied to the light emitting element;

a second switch for switching between a first scan state of setting the gate potential of the drive transistor and a second scan state of keeping the set gate potential of the drive transistor;

a row drive circuit for generating, in response to a clock of an active matrix display operation, a first scan line signal to be applied to the first switch through a scan line so that the first switch switches between the first and second drive states, and a second scan line signal to be applied to the second switch through the scan line so that the second switch switches between the first and second scan states; and a column drive circuit for generating, in response to an image signal, a data signal to be applied to each of the pixel circuits through a data line, wherein said row drive circuit applies, in response to turn-on of a power source or start of a waiting state, a switch control signal to the first and second switches for all of the pixel circuits through the scan line for a predetermined interval after the turn-on of the power source or a waiting state interval, as a priority signal to the first and second scan signals so that, for all of the pixel circuits, the first switch becomes the first drive state and the second switch becomes the first scan state for the predetermined interval or the waiting state interval, and wherein the column drive circuit shuts off the data signal or applies a predetermined low level signal on the data line for all of the pixel circuits during the predetermined interval after the turn-on of the power source or the waiting state interval and prior to a normal display drive period.

2. A display apparatus according to claim 1, wherein each of the pixel circuits further comprises a third switch connected to the data line, with the first scan line signal applied to the third switch through the scan line so that the data signal is applied to the drive transistor and the second switch during the first drive state.

* * * * *